US008018388B2

(12) United States Patent
Kyowski

(10) Patent No.: US 8,018,388 B2
(45) **Date of Patent: *Sep. 13, 2011**

(54) LOW PROFILE ANTENNA INSERT NUT

(75) Inventor: Timothy H. Kyowski, Brantford (CA)

(73) Assignee: Research In Motion Limited, Waterloo (CA)

( * ) Notice: Subject to any disclaimer, the term of this patent is extended or adjusted under 35 U.S.C. 154(b) by 188 days.

This patent is subject to a terminal disclaimer.

(21) Appl. No.: 12/420,537

(22) Filed: Apr. 8, 2009

(65) Prior Publication Data

US 2009/0195476 A1 Aug. 6, 2009

Related U.S. Application Data

(63) Continuation of application No. 12/142,478, filed on Jun. 19, 2008, now Pat. No. 7,525,495, which is a continuation of application No. 11/671,211, filed on Feb. 5, 2007, now Pat. No. 7,403,163, which is a continuation of application No. 11/107,974, filed on Apr. 18, 2005, now Pat. No. 7,190,314, which is a continuation of application No. 10/723,839, filed on Nov. 26, 2003, now abandoned.

(60) Provisional application No. 60/430,078, filed on Dec. 2, 2002.

(51) Int. Cl.
*H01Q 1/24* (2006.01)
*H01Q 1/50* (2006.01)

(52) U.S. Cl. ..... 343/702; 343/906; 439/916

(58) Field of Classification Search ..... 343/702, 343/715, 906, 878; 439/916
See application file for complete search history.

(56) References Cited

U.S. PATENT DOCUMENTS

| | | | | |
|---|---|---|---|---|
| 3,876,277 | A | 4/1975 | Colwell | |
| 5,158,483 | A | 10/1992 | Fisherman et al. | |
| 5,714,963 | A | 2/1998 | Cox | |
| 5,936,581 | A | 8/1999 | Roshitsh et al. | |
| 5,955,999 | A | 9/1999 | Mutz et al. | |
| 5,973,645 | A | 10/1999 | Zigler et al. | |
| 6,034,639 | A | 3/2000 | Hahn et al. | |
| 6,133,885 | A | 10/2000 | Luniak et al. | |
| 6,157,350 | A | 12/2000 | House et al. | |
| 6,300,911 | B1 | 10/2001 | Murray et al. | |
| 6,509,878 | B1 | 1/2003 | Tomatta et al. | |
| 6,639,561 | B2 | 10/2003 | Pruss et al. | |
| 6,710,747 | B1 | 3/2004 | Chang | |
| 6,791,501 | B2 | 9/2004 | Maeda et al. | |
| 6,930,643 | B2 | 8/2005 | Byrne et al. | |
| 7,190,314 | B2 * | 3/2007 | Kyowski | 343/702 |
| 7,403,163 | B2 * | 7/2008 | Kyowski | 343/702 |
| 7,414,586 | B2 * | 8/2008 | Yu | 343/702 |
| 7,466,288 | B2 * | 12/2008 | Huang | 343/906 |

(Continued)

FOREIGN PATENT DOCUMENTS

| | | |
|---|---|---|
| EP | 0800226 | 10/1997 |

(Continued)

*Primary Examiner* — Tan Ho
(74) *Attorney, Agent, or Firm* — Moffat & Co.

(57) ABSTRACT

An antenna mount comprising a front cylindrical mount, the front cylindrical mount having a threaded interior for installing an antenna; a flanged central portion; a base mount consisting of a hollow cylinder cut away along a longitudinal axis, leaving a half-circular cross section. The antenna mount can be installed by inserting it into an opening in the casing of a device and rotating the antenna mount until it abuts a stop stud.

18 Claims, 2 Drawing Sheets

U.S. PATENT DOCUMENTS

| | | | | |
|---|---|---|---|---|
| 7,525,495 | B2 * | 4/2009 | Kyowski | 343/702 |
| 2002/0070903 | A1 | 6/2002 | Nakamura et al. | |
| 2002/0101380 | A1 | 8/2002 | Pruss et al. | |
| 2005/0093755 | A1 | 5/2005 | Byrne et al. | |
| 2006/0077112 | A1 | 4/2006 | Nakano et al. | |

FOREIGN PATENT DOCUMENTS

| | | |
|---|---|---|
| JP | 2000-114835 | 4/2000 |
| WO | 0171844 | 9/2001 |
| WO | 02054539 | 7/2002 |

* cited by examiner

LOW PROFILE ANTENNA INSERT NUT

RELATED APPLICATIONS

The present application is a continuation of U.S. patent application Ser. No. 12/142,478, filed Jun. 19, 2008 which is a continuation of U.S. patent application Ser. No. 11/671,211, filed Feb. 5, 2007, which is a continuation of U.S. Pat. No. 7,190,314, issued Mar. 13, 2007, which is a continuation of U.S. patent application Ser. No. 10/723,839, filed Nov. 26, 2003, now abandoned, which claims priority from Canadian application No. 2413459, entitled "Low Profile Antenna Insert Nut" filed Nov. 29, 2002 and U.S. Provisional Application No. 60/430,078 filed Dec. 2, 2002. The full disclosure, including the drawings, of Canadian Patent application No. 2413459, and U.S. Provisional Application No. 60/430,078, U.S. patent application Ser. No. 10/723,839, U.S. Pat. No. 7,190,314, and U.S. patent Application Ser. No. 11/671,211 and U.S. patent application Ser. No. 12/142,478 are incorporated herein by reference.

FIELD OF THE INVENTION

The present invention relates to mounting fixtures for antennas, and specifically to mounting fixtures for antennas on devices that have significant space restrictions

BACKGROUND TO THE INVENTION

Devices such as cellular telephones or personal digital assistants (PDAs), which will sometimes be collectively referred to as "mobile devices" in the following description, have extreme space restrictions for internal components. Significant design efforts are used to ensure the devices are as small as possible.

One of the larger components within such a device is the antenna mount. Antennas need to be screwed into these mounts, which are installed within the device. However, currently these antenna mounts have large rectangular cross section dimensions at the base end of the mount, creating the need for a significant bulge in the casing to accommodate the mount, or for significant space to be set aside within the device itself.

Another problem with current mounts is then installation. Due to the rectangular or square cross-sectional shape of current mounts, installing them requires sufficient space within the casing to slide the mounts into place. Thus installation process itself also requires more availability of space in the casing.

SUMMARY OF THE INVENTION

The present invention overcomes the disadvantages of the prior art by providing an antenna mount having a circular base portion, of which half is cut away. This configuration provides advantages for both space utilization and installation.

The half circular base of the present invention allows the corner of a circuit board to lie within the space that would otherwise be occupied by the cut-away section, thus allowing the use of a larger circuit board or a smaller casing.

Installation of the present antenna mount is further enhanced by allowing the mount to be inserted with the half circular base positioned inside the casing. The mount can then be rotated 180 degrees to abut mounting studs within the mobile device's housing, the mounting studs holding the antenna mount in place and preventing further rotation. The antenna is then screwed into the mount in a direction in which the antenna mount is forced against the mounting stud which allows the antenna to be fully tightened into the mount.

DETAILED DESCRIPTION OF THE DRAWINGS

Figure 1:
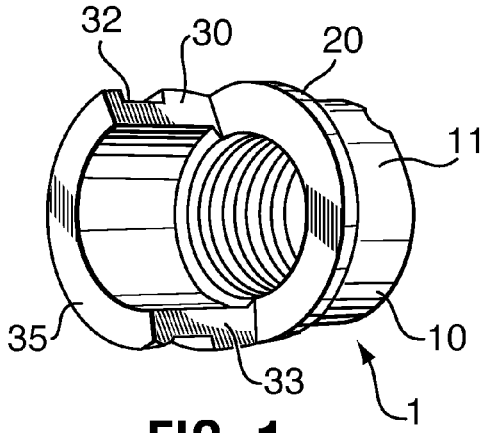
FIG. 1 is a top perspective view of the antenna mount of the present invention.
Figure 2:
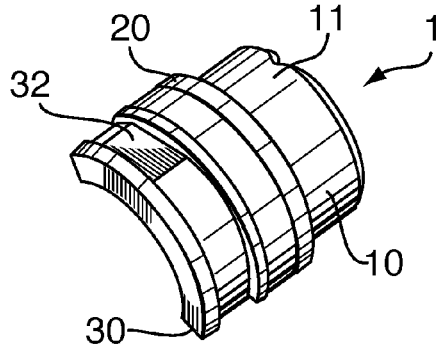
FIG. 2 is a rear perspective view of the antenna mount of FIG. 1.
Figure 3:
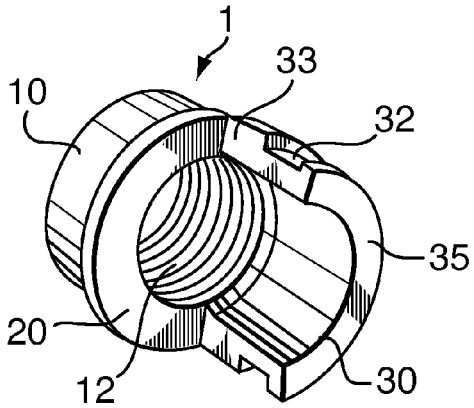
FIG. 3 is a front perspective view of the antenna mount of FIG. 1.
Figure 4:
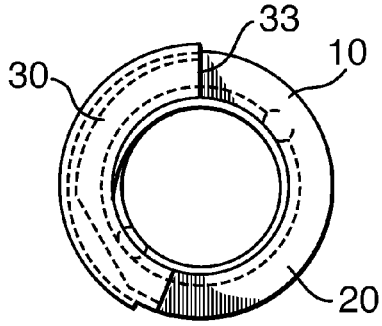
FIG. 4 is a top plan view of the antenna mount of FIG. 1.
Figure 5:
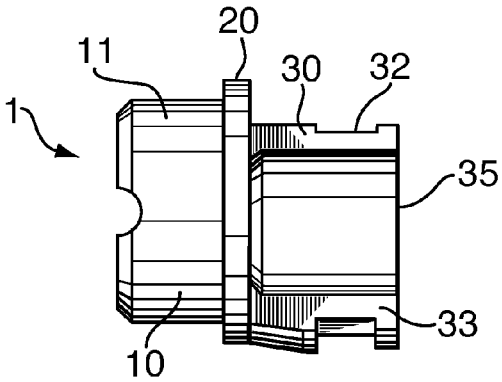
FIG. 5 is a side elevational view of the antenna mount of FIG. 1.
Figure 6:
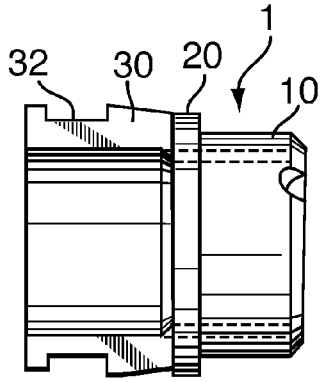
FIG. 6 is a cross-sectional view of the antenna mount of FIG. 1.

Reference is now made to the drawings. FIGS. 1 to 6 illustrate antenna mount 1. Antenna mount 1 consists of a front mount 10, a flange 20, and a base mount 30, each of which is described below.

Front mount 10 is generally cylindrical in shape having a smooth outer surface 11 and an internally threaded bore 12. Outer surface 11 is sized and dimensioned for slidable insertion into an aperture 52 formed in a casing 50 for the mobile device as seen most clearly in FIGS. 7 and 8. Following insertion, the mount is free to rotate within aperture 52.

Flange 20 located between front mount 10 and rear mount 30 is larger in diameter than the front mount to bear against the casing around aperture 52, which limits the mount's insertion into the aperture and prevents its extrusion from the casing.

The threaded bore 12 of the front mount 10 is for connection to the mobile device's correspondingly threaded antenna (not shown).

Base mount 30 is an arced projection, preferably half cylindrical, extending rearwardly from flange 20 and includes a circumferentially extending groove 32 to accommodate antenna contact clip 34 which is used to ensure electrical contact between the antenna and the mobile device's PCB (not shown).

As will be appreciated by one skilled in the art, antenna mount 1 can be manufactured by either casting or machining.

Figure 7:
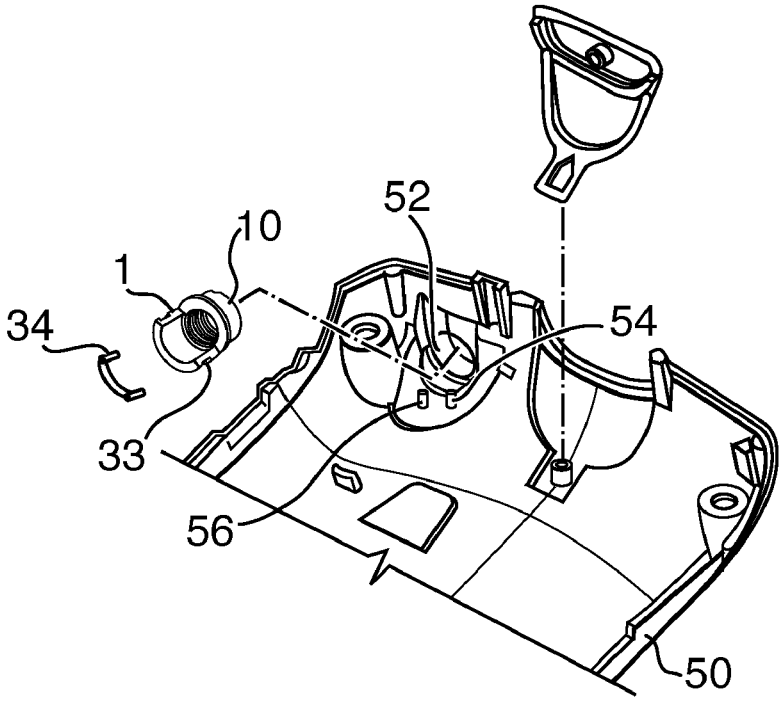
FIG. 7 is a perspective view of the casing of a portion of a casing for a mobile device adapted for use with the mount of FIG. 1.
Figure 8:
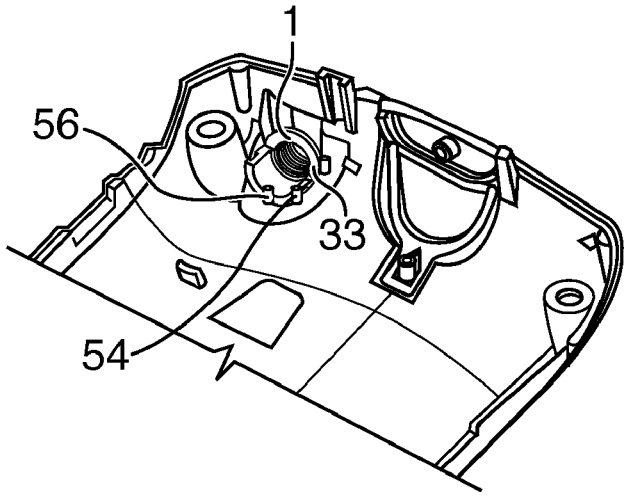
FIG. 8 is a perspective view of the casing of FIG. 7 with the antenna mount installed.

Reference is now made to FIGS. 7 and 8. To install antenna mount 1, the mount is positioned for insertion of front mount 10 into hole 52. Base mount 30 is rotated into a position that allows it to clear studs 54 and 56 located inwardly of aperture 52 as mount 1 is inserted into the aperture to the extent permitted by flange 20.

Antenna mount 1 is then rotated until edge 33 of base mount 30 abuts stud 54. Stud 54 prevents base mount 30 from rotating further. A stud 56 located slightly more inwardly relative to aperture 52 is positioned to bear against the end 35 of base mount 30. Stud 56 prevents antenna mount 1 from moving rearwards into the casing.

The present invention allows a printed circuit board to be installed so that its corner is situated over the cut away portion of base mount 30. This provides the advantage that a smaller casing or a larger circuit board can be used.

The rotation of antenna mount 1, which is metal and conductive, also rotates contact clip 34 to make electrical contact at a terminal (not shown) on the mobile device's printed circuit board.

As aforesaid, an antenna is installed by screwing it into threaded bore 12. The direction of rotation for installing the antenna biases edge 33 of base portion 30 against stud 54, such that antenna mount 1 is prevented from rotating by stud 54 which allows the antenna to be tightly screwed into the mount.

Once the device is fully assembled, the removal of antenna mount 1 is prevented by contact clip 34. Contact clip 34 makes contact with the printed circuit board, thus preventing rotation of antenna mount 1 if the antenna is unscrewed.

The advantage of the present antenna mount is therefore the savings of space in both the x and z axes, and further the ease of installation of the mount.

The above-described embodiments of the present invention are meant to be illustrative of preferred embodiments and are not intended to limit the scope of the present invention. Also, various modifications, which would be readily apparent to one skilled in the art, are intended to be within the scope of the present invention. The only limitations to the scope of the present invention are set forth in the following claims appended hereto.

The invention claimed is:

1. An antenna insert nut comprising:

a front mount having an interior configured to receive an antenna and an exterior configured to be rotatable within a device casing;

a central portion configured to prevent the nut from extruding through said device casing; and a base mount disposed about said central portion, said base mount forming an arced projection configured to receive a circuit board.

2. The antenna insert nut of claim 1, wherein the base mount further includes a circumferentially extending groove on an outer surface of said base mount, said groove configured to accommodate a contact clip.

3. The antenna insert nut of claim 1, wherein said arced projection has an arc of 180 degrees.

4. The antenna insert nut of claim 1, where said arced projection has an arc of less than 180 degrees.

5. The antenna insert nut of claim 1, wherein the exterior of said front mount is smooth.

6. The antenna insert nut of claim 1, wherein the front mount is cylindrical.

7. The antenna insert nut of claim 1, wherein the nut is comprised of cast metal.

8. A device casing for an antenna insert nut comprising:

a hole about an end of said device casing, the hole configured to receive front mount of said antenna insert nut but sized to allow a flanged portion of said nut to abut a periphery of said hole;

a first preventing apparatus configured to abut a base portion of said antenna insert nut and to prevent said antenna insert nut from rotating beyond a predefined limit; and a second preventing apparatus configured to abut the base portion of said antenna insert nut at an edge opposite said flanged portion and configured to prevent said antenna insert nut from moving into said device casing.

9. The device casing of claim 8, wherein the device is a mobile device.

10. The device casing of claim 8, wherein the first preventing apparatus is a stud.

11. The device casing of claim 8, wherein the second preventing apparatus is a stud.

12. An antenna mount system comprising:

an antenna insert nut having:

a front mount having an interior configured to receive an antenna and an exterior configured to be rotatable within a device casing;

a central portion configured to prevent the nut from extruding through said device casing; and a base mount disposed about said central portion, said base mount forming an arced projection configured to receive a circuit board; and a device casing for the antenna insert nut having:

a hole about an end of said device casing, the hole configured to receive the front mount of said antenna insert nut but sized to allow the flanged portion of said nut to abut a periphery of said hole;

a first preventing apparatus configured to abut the base portion of said antenna insert nut and to prevent said antenna insert nut from rotating beyond a predefined limit; and a second preventing apparatus configured to abut the base portion of said antenna insert nut at an edge opposite said flanged portion and configured to prevent said antenna insert nut from moving into said device casing.

13. The antenna mount system of claim 12, wherein the base mount further includes a circumferentially extending groove on an outer surface of said base mount, said groove configured to accommodate a contact clip.

14. The antenna mount system of claim 12, wherein said arced projection has an arc of 180 degrees.

15. The antenna mount system of claim 12, where said arced projection has an arc of less than 180 degrees.

16. The antenna mount system of claim 12, wherein the exterior of said front mount is smooth.

17. The antenna mount system of claim 12, wherein the front mount is cylindrical.

18. The antenna mount system of claim 12, wherein the nut is comprised of cast metal.

* * * * *